US011555285B2

(12) United States Patent
Jia et al.

(10) Patent No.: US 11,555,285 B2
(45) Date of Patent: Jan. 17, 2023

(54) CONSTRUCTION METHOD FOR RECYCLABLE ANCHOR ROD

(71) Applicant: DALIAN UNIVERSITY OF TECHNOLOGY, Dalian (CN)

(72) Inventors: Jinqing Jia, Dalian (CN); Lihua Zhang, Dalian (CN); Xing Gao, Dalian (CN); Bingxiong Tu, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 0 days.

(21) Appl. No.: 17/495,683

(22) Filed: Oct. 6, 2021

(65) Prior Publication Data

US 2022/0267979 A1 Aug. 25, 2022

(30) Foreign Application Priority Data

Feb. 22, 2021 (CN) ..... 202110196821.7

(51) Int. Cl.
*E02D 5/76* (2006.01)
*E02D 5/80* (2006.01)
*E04H 9/02* (2006.01)

(52) U.S. Cl.
CPC ..... *E02D 5/765* (2013.01); *E02D 5/801* (2013.01); *E04H 9/02* (2013.01); *E02D 2600/30* (2013.01)

(58) Field of Classification Search
CPC combination set(s) only.
See application file for complete search history.

(56) References Cited

FOREIGN PATENT DOCUMENTS

| | | | | |
|---|---|---|---|---|
| CN | 111321735 A | * | 6/2020 | |
| CN | 111663527 A | * | 9/2020 | ..... E02D 17/04 |
| CN | 111997048 A | * | 11/2020 | ..... E02D 5/765 |
| CN | 113463651 A | * | 10/2021 | |
| EP | 3988717 A1 | * | 4/2022 | |
| KR | 100599332 B1 | * | 7/2006 | |

* cited by examiner

*Primary Examiner* — Kyle Armstrong
(74) *Attorney, Agent, or Firm* — Brooks Kushman, P.C.

(57) ABSTRACT

A construction method for a recyclable anchor rod. The recyclable anchor rod includes a reinforcing steel bar body and an unlocking device. The unlocking device includes a housing, a fixed panel, a top limiter, lifting screw limiters, a lifting screw, transmission gears, gear clamping arms, a thread limiter, and a pressure bearing plate. The construction method includes: 1, positioning; 2, drilling; 3, anchoring; 4, performing primary grouting; 5, performing secondary grouting; 6, tensioning and locking; and 7, recycling the reinforcing steel bar body. Shock-absorbing pressure-bearing devices are arranged between the lower end of the housing and the pressure bearing plate. The present disclosure effectively solves the problems that a conventional anchor rod hinders the construction of an adjacent underground structure and pollutes underground environment, and the problems that the existing recyclable anchor rod unlocking device is unstable, does not have earthquake resistance, and cannot realize 100% recovery of rod bodies.

9 Claims, 8 Drawing Sheets

CONSTRUCTION METHOD FOR RECYCLABLE ANCHOR ROD

CROSS REFERENCE TO RELATED APPLICATION

This application claims foreign priority benefits under 35 U.S.C. § 119(a)-(d) to CN Application No. 202110196821.7, filed on Feb. 22, 2021, which is hereby incorporated by reference in its entirety.

TECHNICAL FIELD

The present disclosure belongs to the technical field of rock and soil anchorage, and particularly, relates to a construction method for a recyclable anchor rod.

BACKGROUND ART

With continuous development of urban development, there are more and more high-rise buildings. Infrastructure construction, such as subways and pipe galleries, growing year by year. A large number of anchor rods remain underground after the failure of support and protection of a foundation pit engineering, which becomes an obstacle to the construction of surrounding adjacent buildings or structures. Meanwhile, reinforcing steel bars or steel strands that exist underground for a long can cause underground environmental metal pollution and result in adverse consequences, such as soil degradation and ecological deterioration.

Based on this, a series of recyclable anchors are developed in rock and soil anchorage industry. However, the recyclable anchor rods on the market today generally have the following problems: 1, the anchor rod unlocking device is not firmly locked, and the reinforcing steel bar body is pulled out when the anchor rod is tensioned; 2, the anchor rod unlocking device is unstable, and the device fails during unlocking, so that the recovery of the reinforcing steel bar body fails; 3, the recyclable anchor rod does not have earthquake resistance, and under the action of an earthquake load, the stress of the anchor rod is greatly increased, which causes locking failure and damage of the unlocking device or the breakage of the reinforcing steel bar body; and 4, the anchor rod is damaged after an earthquake, the pre-stress loss cannot be recycled, and the anchor rod cannot be effectively remedied after failure.

SUMMARY

In view of the above-mentioned technical problems, the present disclosure aims to provide a construction method for an anchor rod which has the advantages of firm locking, stable unlocking performance, excellent earthquake resistance, capacity of being repaired after an earthquake, environmental friendliness, and energy conservation and emission reduction.

The technical solution adopted by the present disclosure is that:

In a construction method for a recyclable anchor rod, the recyclable anchor rod includes a reinforcing steel bar body, an unlocking device, a base plate, and an anchor head. The tail end of the reinforcing steel bar body is an unlocking end. The unlocking end includes a first conventional section, a first diameter reducing section, a second conventional section, a threaded section, and a second diameter reducing section from bottom to top. The diameter of the second diameter reducing section is less than or equal to the minor diameter of thread (minor diameter) of the threaded section. The cross section of the top of the second diameter reducing section is in a radial sawtooth shape. The unlocking device includes a housing, a top limiter located at the top end of the housing, and a fixed panel fixedly connected to the housing. Annular lifting screw limiters are arranged on the fixed panel. The lifting screw penetrates through the lifting screw limiters. The internal threads of the lifting screw limiters are engaged with the external threads of the lifting screw. The cross section of the bottom of the lifting screw is in a radial sawtooth shape and is matched with the cross section of the top of the second reducing section. Transmission gears are symmetrically fixed to the left side and the right side of the fixed panel through a transmission gear shaft. Gear clamping arms are fixed to the left end and the right end of the fixed panel through a gear clamping arm shaft. The transmission gears are in engaged connection with the external threads of the lifting screw. Gears at the upper ends of the gear clamping arms are in engaged connection with the transmission gears. Open-close type pressure bearing semi-circular rings are arranged at the lower ends of the gear clamping arms. The lifting screw limiters fixedly connected to the housing are arranged below the fixed panel. The threaded section penetrates through the lifting screw limiters. The external threads of the threaded section are in engaged connection with the internal threads of the lifting screw limiters. A pressure bearing plate is arranged at the lower end of the housing.

The construction method includes the following steps:

step one, determining a mounting position of the anchor rod;

step two, performing drilling treatment;

step three, combining and mounting the anchor rod: combining the unlocking end and the unlocking device; bonding the two open-close type pressure bearing semi-circular rings into an open-close type pressure bearing ring; making the first diameter reducing section penetrate through the open-close type pressure bearing ring without friction therebetween; tensioning the first diameter reducing section through the gear clamping arms, where dual locking of the reinforcing steel bar body is realized by the open-close type pressure bearing ring and the lifting screw limiters; placing the anchor rod;

step four, performing primary grouting;

step five, performing secondary splitting grouting;

step six, tensioning and locking the anchor rod; and step seven, recycling the reinforcing steel bar body after the anchor rod completes supporting and protecting tasks: removing the base plate and anchor rod; rotating the reinforcing steel bar body clockwise; making the reinforcing steel bar body rise; making the first diameter reducing section move upwards in the open-close type pressure bearing ring, where the sawteeth of the cross section of the top of the first diameter reducing section are engaged with the sawteeth of the cross section of the bottom of the lifting screw; meanwhile, driving the lifting screw to rise rotatably, where the lifting screw rises rotatably to drive the transmission gears to rotate, so as to drive the gear clamping arms to unfold; opening the open-close type pressure bearing ring, unlocking the first diameter reducing section of the reinforcing steel bar body to complete a first unlocking program; then continuing rotating the reinforcing steel bar body clockwise; and when the lifting screw touches the top limiter, rotating the reinforcing steel bar body reversely, where a second unlocking program is completed when the threaded section of the reinforcing steel bar body is rotated out of the thread limiter, and then that the reinforcing steel bar body can be pulled out.

Shock-absorbing pressure-bearing devices are arranged between the lower end of the housing and the pressure bearing plate. The housing includes an inner housing and an outer housing that are nested and connected in a sliding manner. Each shock-absorbing pressure-bearing device includes an outer mold, a moving plate, and a shock absorber. The lower surface of the bottom of the outer mold is fixedly connected to the pressure bearing plate. The top of the outer mold is fixedly connected to the outer housing in a sealed manner; the upper surface of the top of the moving plate is fixedly connected to the lower end of the inner housing. The outer side wall of the moving plate is connected to the inner side wall of the outer mold in a sliding manner. The shock absorber includes a top sliding block and a sleeve base. The upper surface of the top sliding block is fixedly connected to the lower surface of the top of the moving plate. The lower surface of the bottom of the sleeve base is fixedly connected to the upper surface of the bottom of the outer mold. The top sliding block includes a top sliding block outer ring body and a top sliding block central body. The top sliding block central body includes a variable diameter head and a constant diameter shaft. The diameter of the variable diameter head is greater than that of the constant diameter shaft. The outer side wall of the lower part of the top sliding block outer ring body is connected to the inner side wall of the sleeve base in a sliding manner. A limiting clamping seat is located below the top sliding block, and the outer side wall of the limiting clamping seat is connected to the inner side wall of the lower part of the top sliding block outer ring body. A hole is formed in the top of the limiting clamping seat. The variable diameter head is connected to the inner side wall of the limiting clamping seat in a sliding manner through the hole; and the limiting clamping seat limits the reducing head. A support seat is arranged on the upper surface of the bottom of the limiting clamping seat. The lower surface of the bottom of the limiting clamping seat is fixedly connected to the upper surface of the bottom of the sleeve base. A spring surrounds the outer side of the limiting clamping seat. The distance between the spring and the top sliding block outer ring body is greater than the distance between the lower surface of the top of the limiting clamping seat and the top of the variable diameter head. An annular rubber block is arranged on the outer side of the spring. The height of the annular rubber block is less than that of the spring. The height of the spring is less than that of the limiting clamping seat. The annular rubber block is nested inside the sleeve base, and the outer side wall of the annular rubber block is connected to the inner side wall of the sleeve base in a sliding manner; and step three further includes a step of combining the shock-absorbing pressure-bearing devices.

The fixed panel, the thread limiter, and the top limiter are fixed to the inner housing.

The principle of the construction method for a recyclable anchor rod is that when the tension of the anchor rod exceeds a limit value, the inner housing moves downwards, the top sliding block central body penetrates through the limiting clamping seat, a top sliding block moves downwards to release partial stress. The top sliding block continues moving downwards, the spring is firstly pressed, partial stress is released again through compression deformation of the spring, and then the top sliding block continues moving downwards to press the spring and the annular rubber block simultaneously, so that partial stress is released again. Therefore, an earthquake resisting effect of the anchor rod is achieved. When the anchor rod is tensioned again after an earthquake, the top sliding block central body and the support seat act, a support body limits further downward movement of the top sliding block. At this time, a shock absorbing system achieves a stable and balanced state, and the working state of the anchor rod before the earthquake can be reached through further tensioning and locking.

The shock-absorbing pressure-bearing devices are symmetrically distributed on the periphery of the reinforcing steel bar body.

The support seat is arranged below the variable diameter head.

The diameter of the second diameter reducing section is less than or equal to the minor diameter of thread of the threaded section so that the second diameter reducing section penetrates through the thread limiter smoothly.

Lifting screw limiters are symmetrically arranged at the upper end and the lower end of the fixed panel.

The recyclable anchor rod further includes a plastic sleeve. The lubricating treatment is performed between the reinforcing steel bar body and the plastic sleeve. There is no friction between the reinforcing steel bar body and the plastic sleeve. The reinforcing steel bar body can rotate and slide freely in the plastic sleeve, so as to rotate in, rotate out, or pull out the reinforcing steel bar body.

Two sides of the open-close type pressure bearing semicircular rings are bonded into an open-close type pressure bearing ring by using adhesive tapes. The adhesive tapes achieve an effect of fixing when the open-close type pressure bearing ring is closed. When the gear clamping arms are unfolded, the open-close type pressure bearing ring is open, and the adhesive tapes are damaged.

In step three, the shock-absorbing pressure-bearing devices are fixed to the pressure bearing plate by welding, bolting, etc.

In step six, when the anchor rod is subjected to an earthquake damage during supporting and protecting, tensioning and locking processes may be repeated after an earthquake, so as to recover a working state of the anchor rod before the earthquake.

The present disclosure has the following beneficial effects:

1. The unlocking device is locked firmly. The unlocking device fails during locking, and a reinforcing steel bar body may be pulled when the reinforced steel bar body is prestressed and tensioned, so that the anchoring fails. When the unlocking device of the present disclosure locks the reinforcing steel bar body, dual locking is realized by using the open-close type bearing ring and the thread limiter, which avoids locking failure of the unlocking device during prestressing and tensioning.

2. The unlocking performance of the unlocking device is stable. The main problem of anchor rod recovery failure is the failure of the unlocking device. The present disclosure adopts mechanical unlocking, and unlocking can be realized by rotating the reinforcing steel bar body, so that the operation is simple, the performance is stable, and 100% recovery of the reinforcing steel bar body can be realized.

3. The earthquake resistance is excellent. The conventional recyclable anchor rod does not have earthquake resistance. Under the action of an earthquake load, the stress of the anchor rod is increased suddenly, which causes locking failure and damage of the unlocking device or the tensile failure of the reinforced bar body. The present disclosure provides an earthquake resistant recyclable anchor rod. When an earthquake disaster happens, the shock-absorbing pressure-bearing devices can automatically absorb energy and release energy, so as to prevent the stress of the anchor rod from increasing suddenly. The stress of the anchor rod is reduced through a process of releasing the stress orderly step by step, so that the unlocking device is ensured to be intact after the earthquake disaster, and a rod body is not damaged.

4. The anchor rod can be repaired after the earthquake. Due to a special structure of the shock absorber in the present disclosure, the bottom of the central body of the top sliding block of the shock absorber acts on the top of the support seat when the shock absorber is tensioned again, and the system reaches a stable state and is locked after the shock absorber is continuously tensioned to a specified value. Due to the protection of a shock absorbing system, the unlocking device and the rod body are still intact after the earthquake, the tensioned shock absorbing system is in a stable balanced state, and the working state of the anchor rod at this time can be completely restored to the state before the earthquake.

5. Smooth construction of adjacent engineering is guaranteed. The reinforcing steel bar body in the present disclosure can be completely recycled, which can effectively solve the problem that a steel stranded wire winds a shield cutter head during shield tunneling construction, and does not affect the excavation of surrounding foundation pits and the construction of adjacent underground structures.

6. The construction method has the advantages of environment friendliness, energy conservation, and emission reduction. Reinforcing steel bar bodies and steel stranded wire deeply buried underground can cause metal pollution in underground environment, and cause adverse consequences, such as soil degradation and ecological deterioration. According to the present disclosure, the reinforcing steel bar bodies are recycled, which can effectively prevent environmental damage. In addition, the recycled reinforcing steel bars can be reused, so energy is saved, emission is reduced, and sustainable development is realized.

Reference signs in drawings: 1—reinforcing steel bar body; 2—unlocking device; 3—first conventional section; 4—first diameter reducing section; 5—second conventional section; 6—threaded section; 7—second diameter reducing section; 8—housing; 801—inner housing; 802—outer housing; 9—top limiter; 10—fixed panel; 11—lifting screw limiter; 12—lifting screw; 13—transmission gear; 14—transmission gear shaft; 15—gear clamping arm; 16—gear clamping arm shaft; 17—thread limiter; 18—open-close type pressure bearing semi-circular ring; 19—shock-absorbing pressure-bearing device; 1901—outer mold; 1902—moving plate; 20—shock absorber; 2001—top sliding block; 2001*a*—top sliding block outer ring body; 2001*b*—top sliding block central body; 2001*b*1—variable diameter head; 2001*b*2—constant diameter shaft; 2002—limiting clamping seat; 2003—support seat; 2004—spring; 2005—annular rubber block; 2006—sleeve base; 21—pressure bearing plate; 22—plastic sleeve; and 23—adhesive tape.

DETAILED DESCRIPTION

It should be understood that orientations or positional relationships indicated by the terms "length", "width", "upper", "lower", "front", "rear", "left", "right", "vertical", "longitudinal", "horizontal", "top", "bottom", "inside", "outside", etc. are the orientations or positional relationships shown based on the accompanying drawings, and are merely for facilitating describing the present disclosure and simplifying the description, rather than indicating or implying that the devices or elements must have particular orientations, and be constructed and operated in particular orientations. Thus, it cannot be construed as a limitation to the present disclosure.

Embodiment 1

Figure 1:
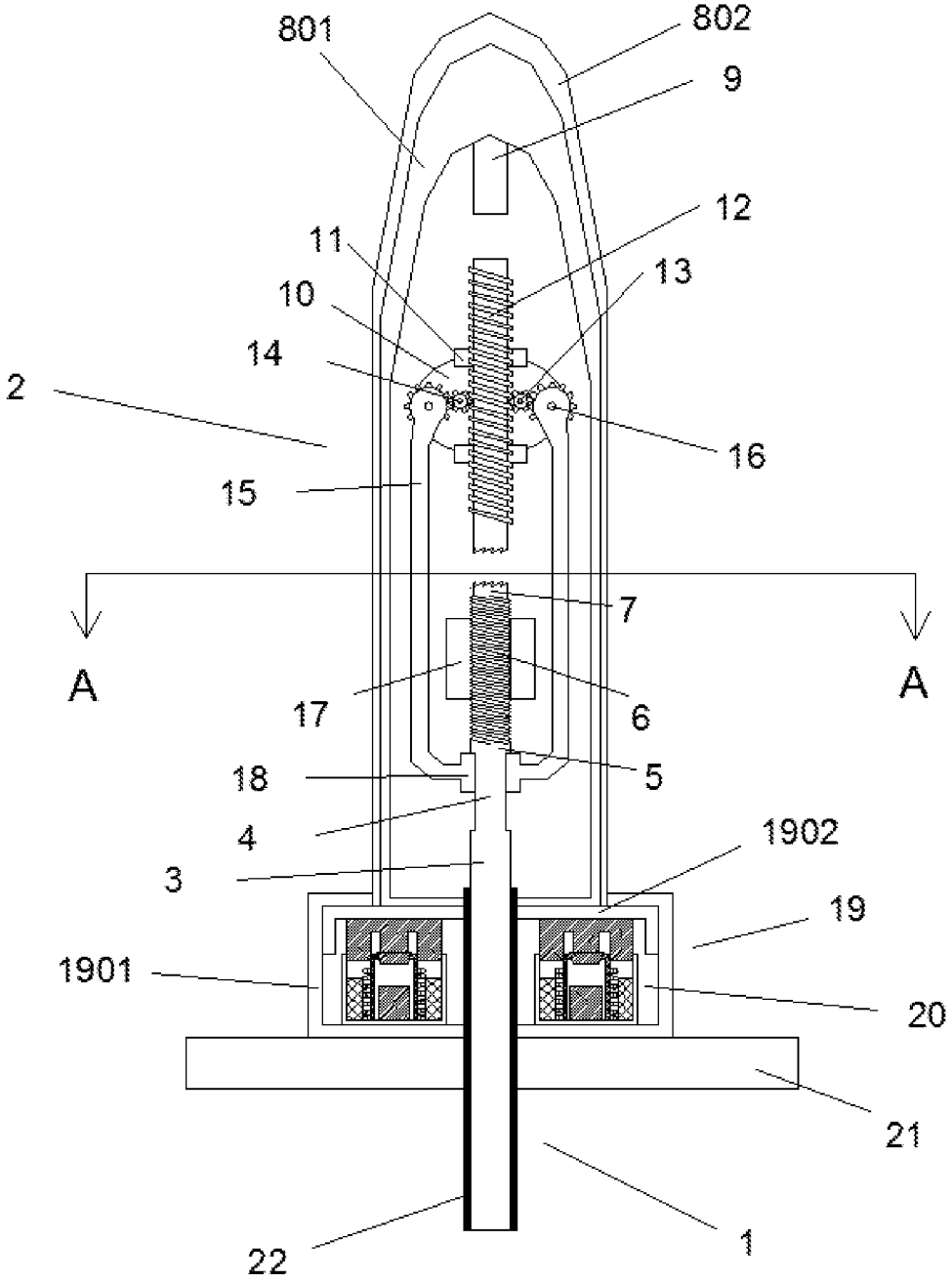
FIG. 1 is a schematic diagram of the present disclosure.
Figure 2:
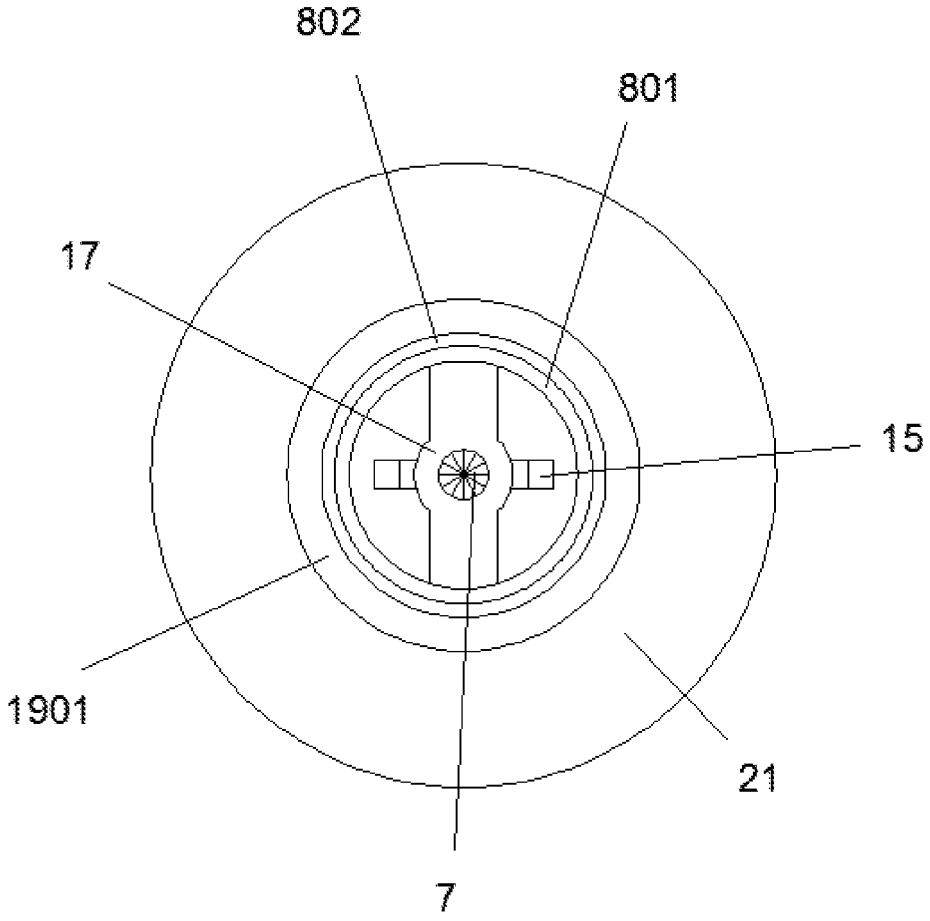
FIG. 2 is an A-A sectional view.
Figure 3:
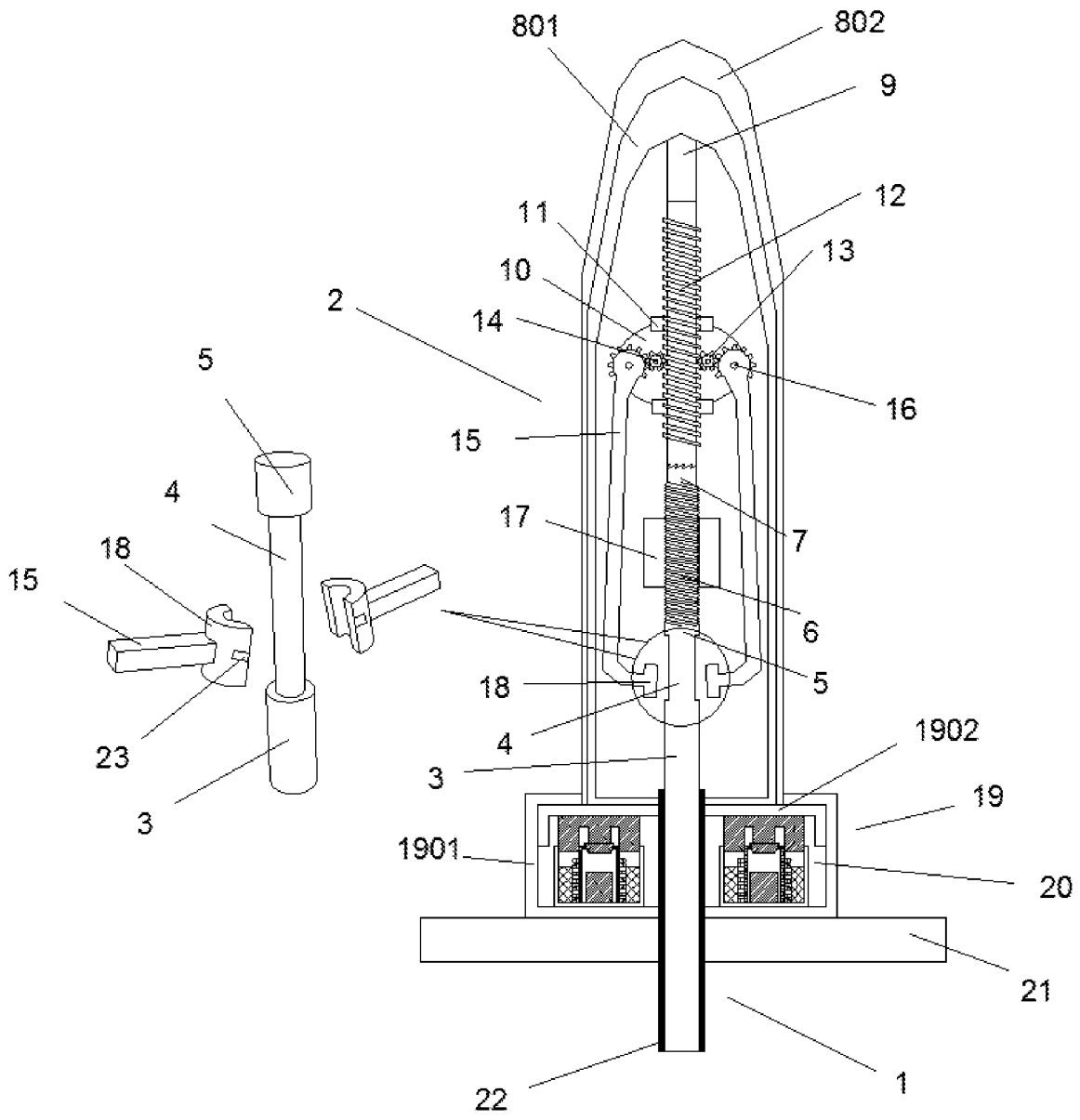
FIG. 3 is an unlocked schematic diagram of the present disclosure.
Figure 4:
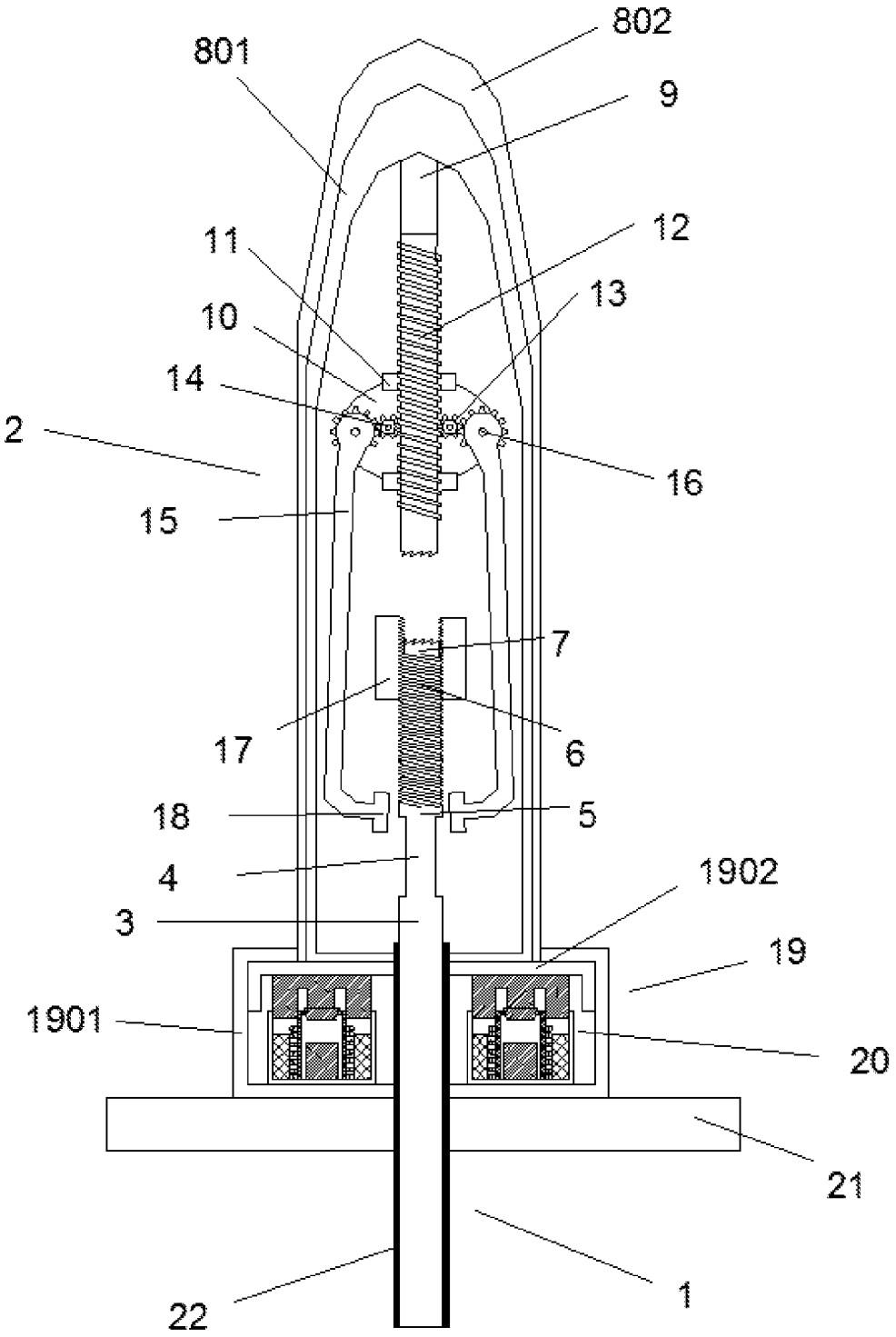
FIG. 4 is a schematic diagram of recycling a reinforcing steel bar body of the present disclosure.
Figure 5:
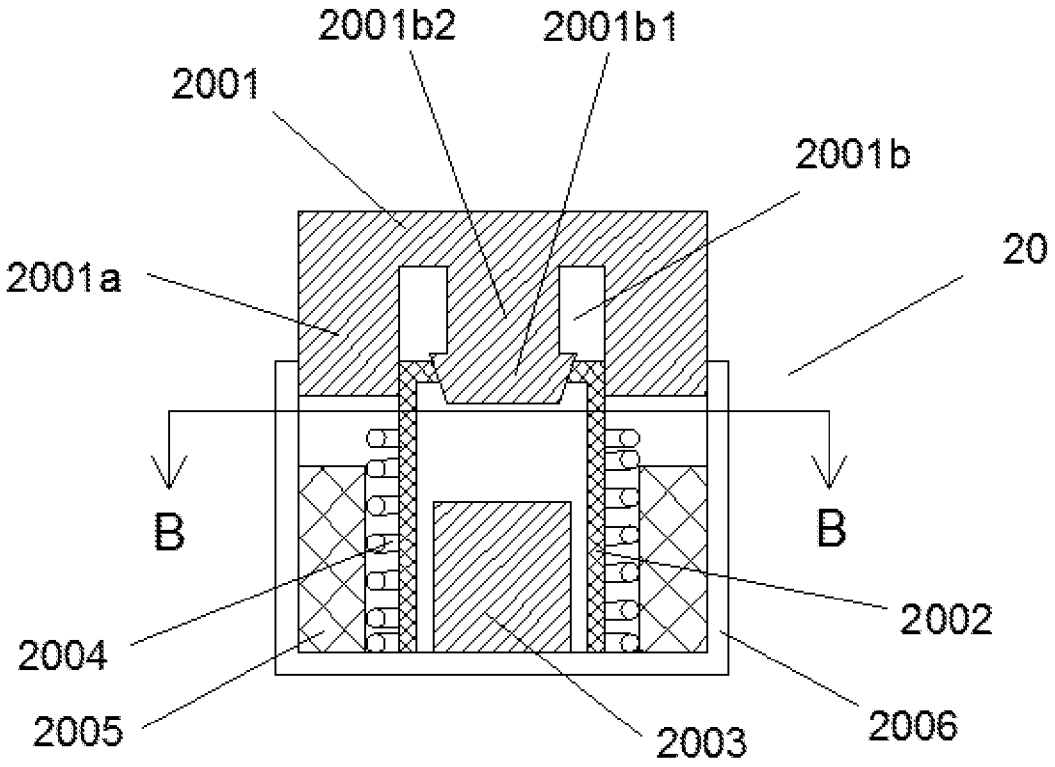
FIG. 5 is a schematic diagram of a shock absorber under normal conditions.
Figure 6:
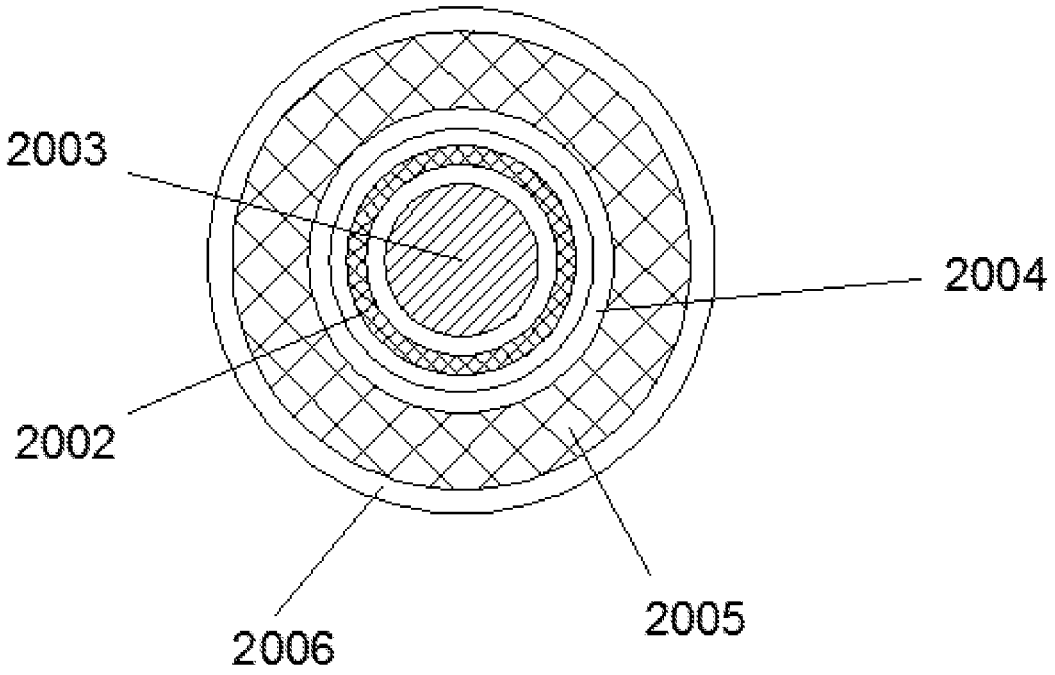
FIG. 6 is a B-B sectional view.
Figure 7:
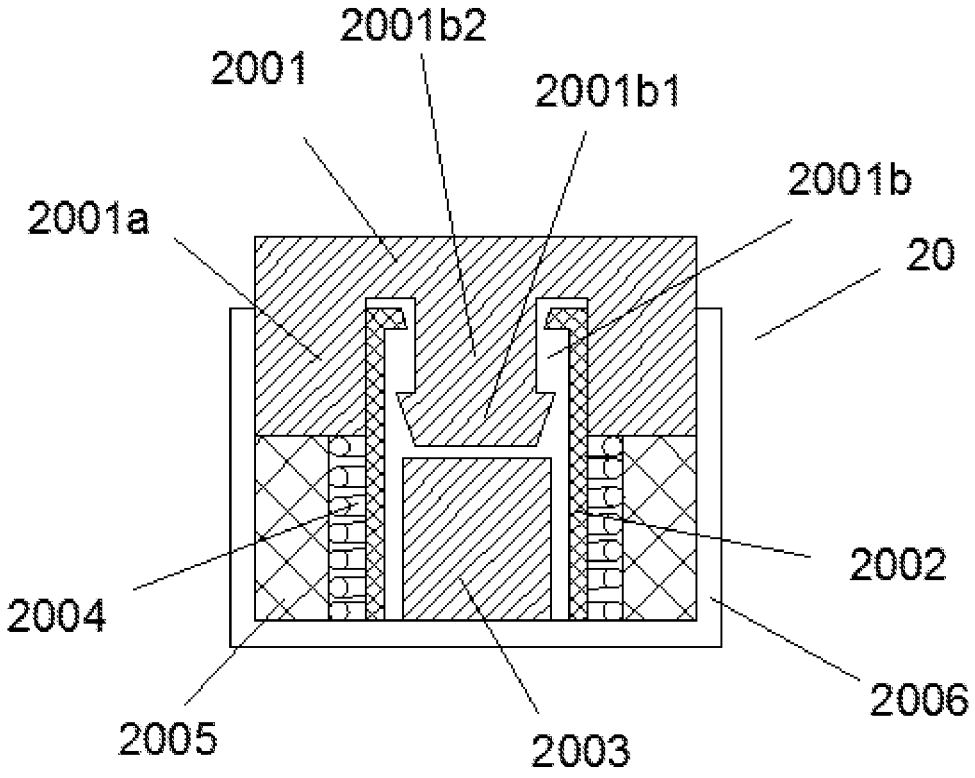
FIG. 7 is a schematic diagram of the shock absorber during shock absorbing.
Figure 8:
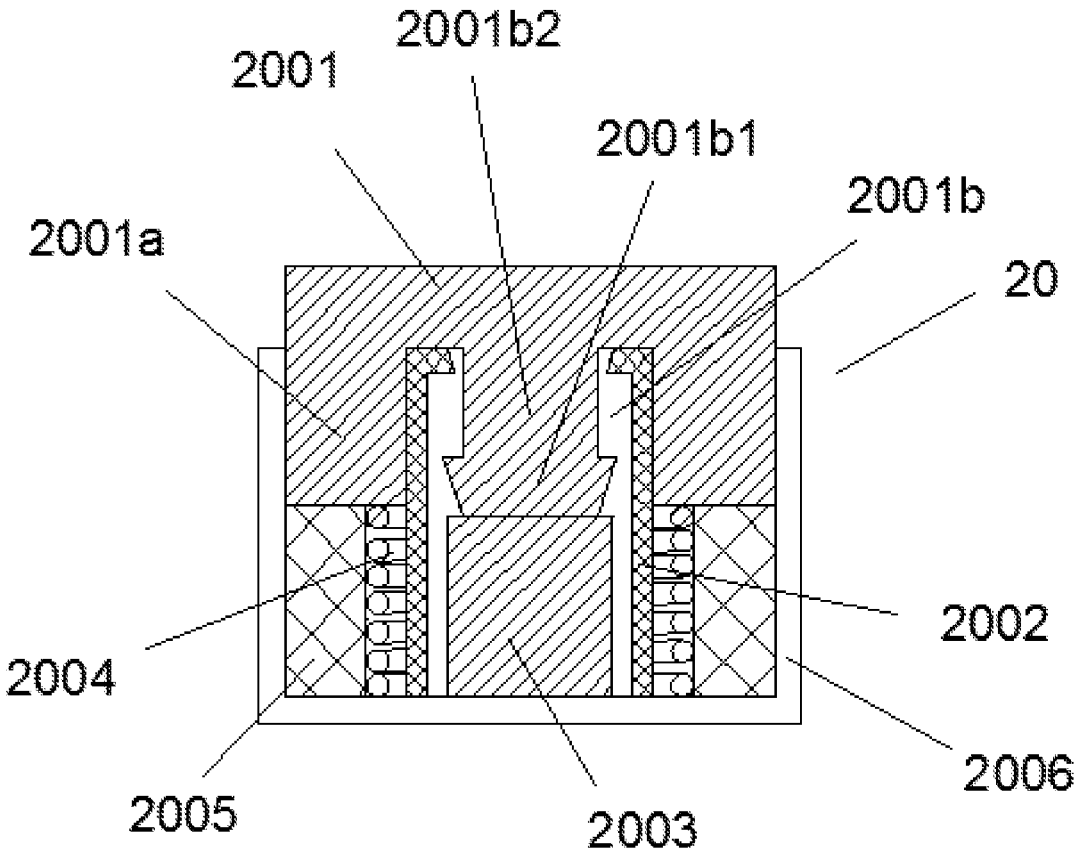
FIG. 8 is a schematic diagram of the shock absorber after being tensioned and locked after an earthquake.

FIG. 1, FIG. 2, FIG. 3, FIG. 4, FIG. 5, FIG. 6, FIG. 7, and FIG. 8 show a construction method for an earthquake resistant recyclable anchor rod. The earthquake resistant recyclable anchor rod includes a reinforcing steel bar body 1 and an unlocking device 2. The tail end of the reinforcing steel bar body 1 is an unlocking end. The unlocking end includes a first conventional section 3, a first diameter reducing section 4, a second conventional section 5, a threaded section 6, and a second diameter reducing section 7 from bottom to top. The diameter of the second diameter reducing section 7 is less than or equal to the minor diameter of thread of the threaded section 6. The cross section of the top of the second diameter reducing section 7 is in a radial sawtooth shape. The unlocking device includes a housing 8, the housing 8 including an inner housing 801 and an outer housing 802 that are nested and are connected in a sliding manner, a top limiter 9 located at the top end of the inner housing 801, and a fixed panel 10 fixedly connected to the inner housing 8. Annular lifting screw limiters 11 are symmetrically arranged at the upper end and the lower end of the fixed panel 10. The lifting screw 12 penetrates through the lifting screw limiters 11. The internal threads of the lifting screw limiters 11 are engaged with the external threads of the lifting screw 12. The cross section of the bottom of the lifting screw 12 is in a radial sawtooth shape and is matched with the cross section of the top of the second reducing section 7. Transmission gears 13 are symmetrically fixed to the left side and the right side of the fixed panel 10 through a transmission gear shaft 14. Gear clamping arms 15 are fixed to the left end and the right end of the fixed panel 10 through a gear clamping arm shaft 16. The transmission gears 13 are in engaged connection with the external threads of the lifting screw 12. Gears at the upper ends of the gear clamping arms 15 are in engaged connection with the transmission gears 13. Open-close type pressure bearing semi-circular rings 18 are arranged at the lower ends of the gear clamping arms 15. A thread limiter 17 fixedly connected to the inner housing 801 is arranged below the fixed panel 10. The threaded section 6 penetrates through the thread limiter 17. The external threads of the threaded section 6 are in engaged connection with the internal threads of the screw limiter 17. Shock-absorbing pressure-bearing devices 19 are arranged at the lower end of the housing 8. The shock-absorbing pressure-bearing devices 19 are symmetrically distributed on the periphery of the reinforcing steel bar body 1. Each shock-absorbing pressure-bearing device 19 includes an outer mold 1901, a moving plate 1902, and a shock absorber 20. The lower surface of the bottom of the outer mold 1901 is fixedly connected to a pressure bearing plate 21. The top of the outer mold 1901 is fixedly connected to the outer housing 802 in a sealed manner. The upper surface of the top of the moving plate 1902 is fixedly connected to the lower end of the inner housing 801. The outer side wall of the moving plate 1902 is connected to the inner side wall of the outer mold 1901 in a sliding manner. The shock absorber 20 includes a top sliding block 2001 and a sleeve base 2006. The upper surface of the top sliding block 2001 is fixedly connected to the lower surface of the top of the moving plate 1902. The lower surface of the bottom of the sleeve base 2006 is fixedly connected to the upper surface of the bottom of the outer mold 1901. The top sliding block 2001 includes a top sliding block outer ring body 2001*a* and a top sliding block central body 2001*b*. The top sliding block central body 2001*b* includes a variable diameter head 2001*b*1 and a constant diameter shaft 2001*b*2. The diameter of the variable diameter head 2001*b*1 is greater than that of the constant diameter shaft 2001*b*2. The outer side wall of the lower part of the top sliding block outer ring body 2001*a* is connected to the inner side wall of the sleeve base in a sliding manner. A limiting clamping seat 2002 is located at the lower end of the top sliding block 2001, and the outer side wall of the limiting clamping seat 2002 is connected to the inner side wall of the lower part of the top sliding block outer ring body 2001*a*. A hole is formed in the top of the limiting clamping seat 2002. The variable diameter head is connected to the inner side wall of the limiting clamping seat 2002 in a sliding manner through the hole. The limiting clamping seat 2002 limits the variable diameter head 2201*b*1. A support seat 2003 is arranged on the upper surface of the bottom of the limiting clamping seat 2002. The support seat 2003 is arranged below the variable diameter head 2201*b*1. The lower surface of the bottom of the limiting clamping seat 2002 is fixedly connected to the upper surface of the bottom of the sleeve base 2006. A spring 2004 surrounds the outer side of the limiting clamping seat 2002. The distance between the spring 2004 and the top sliding block outer ring body 2001*a* is greater than that between the lower surface of the top of the limiting clamping seat 2002 and the top of the variable diameter head 2001*b*1. An annular rubber block 2005 is arranged on the outer side of the spring 2004. The height of the annular rubber block 2005 is less than that of the spring 2004. The height of the spring 2004 is less than that of the limiting clamping seat 2002. The annular rubber block 2005 is nested inside the sleeve base 2006, and the outer side wall of the annular rubber block 2005 is connected to the inner side wall of the sleeve base 2006 in a sliding manner. The recyclable anchor rod further includes a plastic sleeve 22. Lubricating treatment is performed between the reinforcing steel bar body 1 and the plastic sleeve 22, and there is no friction therebetween. The reinforcing steel bar body 1 can rotate and slide freely in the plastic sleeve 22, so as to rotate in, rotate out, or pull out the reinforcing steel bar body 1.

The construction method includes the following steps:

step one, a mounting position of the anchor rod is determined;

step two, drilling treatment is determined;

step three, the anchor rod is combined and mounted: the anchor rod is combined and mounted: the unlocking end and the unlocking device 2 are combined; the two open-close type pressure bearing semi-circular rings 18 are bonded into an open-close type pressure bearing ring; the first diameter reducing section 4 penetrates through the open-close type pressure bearing ring without friction therebetween; the first diameter reducing section 4 is tensioned through the gear clamping arms 15; dual locking of the reinforcing steel bar body 1 is realized by the open-close type pressure bearing ring and the thread limiter 17; the anchor rod is placed;

step four, primary grouting is performed;

step five, secondary splitting grouting is performed;

step six, the anchor rod is tensioned and locked; and step seven, the reinforcing steel bar body 1 is recycled after the anchor rod completes supporting and protecting tasks: the base plate and anchor rod are removed; the reinforcing steel bar body 1 is rotated upwards clockwise; the reinforcing steel bar body 1 rises; the first diameter reducing section 4 moves upwards in the open-close type pressure bearing ring; the sawteeth of the cross section of the top of the first diameter reducing section 4 are engaged with the sawteeth of the cross section of the bottom of the lifting screw 12; meanwhile, the lifting screw 12 is driven to rise rotatably; the lifting screw 12 rises rotatably to drive the transmission gears 13 to rotate, so as to drive the gear clamping arms 15 to unfold; a plastic bag breaks; the open-close type pressure bearing ring is open; the first diameter reducing section 4 of the reinforcing steel bar body is unlocked to complete a first unlocking program; then the reinforcing steel bar body is continuously rotated clockwise; when the lifting screw 12 touches the top limiter 9, the reinforcing steel bar body 1 is rotated reversely; and a second unlocking program is completed when the threaded section 6 of the reinforcing steel bar body 1 is rotated out of the thread limiter 17, so that the reinforcing steel bar body 1 can be pulled out.

In step three, the shock-absorbing pressure-bearing devices 19 (the lower surface of the bottom of the outer mold 1901) are fixed to the pressure bearing plate 21 by welding or bolting.

In step six, when the anchor rod is subjected to an earthquake damage during supporting and protecting, tensioning and locking processes may be repeated after an earthquake, so as to recover a working state of the anchor rod before the earthquake.

The present disclosure effectively solves the problems that a conventional anchor rod hinders the construction of an adjacent underground structure and pollutes underground environment, and the problems that the existing recyclable anchor rod unlocking device is unstable, does not have earthquake resistance and cannot realize 100% recovery of rod bodies. The present disclosure provides an anchor rod which has the advantages of firm locking, stable unlocking performance, excellent earthquake resistance, capacity of being repaired after the earthquake, environmental friendliness, energy conservation and emission reduction, and has wide application prospect and remarkable economic and social benefits.

What is claimed is:

1. A construction method for a recyclable anchor rod, wherein the recyclable anchor rod comprises a reinforcing steel bar body, an unlocking device, a base plate, and an anchor head; the tail end of the reinforcing steel bar body is an unlocking end; the unlocking end comprises a first section, a first diameter reducing section, a second section, a threaded section, and a second diameter reducing section from bottom to top; the diameter of the second diameter reducing section is less than or equal to the thread inner diameter of the threaded section; the cross section of the top of the second diameter reducing section is in a radial sawtooth shape; the unlocking device includes a housing, a top limiter located at the top end of the housing, and a fixed panel fixedly connected to the housing; annular lifting screw limiters are arranged on the fixed panel; the lifting screw penetrates through the lifting screw limiters; the internal threads of the lifting screw limiters are engaged with the external threads of the lifting screw; the cross section of the bottom of the lifting screw is in a radial sawtooth shape and is matched with the cross section of the top of the second reducing section; transmission gears are symmetrically fixed to the left side and the right side of the fixed panel through a transmission gear shaft; gear clamping arms are fixed to the left end and the right end of the fixed panel through a gear clamping arm shaft; the transmission gears are in engaged connection with the external threads of the lifting screw; gears at the upper ends of the gear clamping arms are in engaged connection with the transmission gears; open-close type pressure bearing semi-circular rings are arranged at the lower ends of the gear clamping arms; the lifting screw limiters fixedly connected to the housing are arranged below the fixed panel; the threaded section penetrates through the lifting screw limiters; the external threads of the threaded section are in engaged connection with the internal threads of the lifting screw limiters; a pressure bearing plate is arranged at the lower end of the housing;

the construction method comprises the following steps:

step one, determining a mounting position of an anchor rod;

step two, performing drilling treatment;

step three, combining and mounting the anchor rod: combining the unlocking end and the unlocking device; bonding the two open-close type pressure bearing semi-circular rings into an open-close type pressure bearing ring; making the first diameter reducing section penetrate through the open-close type pressure bearing ring without friction therebetween; tensioning the first diameter reducing section through the gear clamping arms, wherein dual locking of the reinforcing steel bar body is realized by the open-close type pressure bearing ring and the lifting screw limiters; placing the anchor rod;

step four, performing primary grouting;

step five, performing secondary splitting grouting;

step six, tensioning and locking the anchor rod; and step seven, recycling the reinforcing steel bar body after the anchor rod completes supporting and protecting tasks: removing the base plate and anchor rod; rotating the reinforcing steel bar body clockwise; making the reinforcing steel bar body rise; making the first diameter reducing section move upwards in the open-close type pressure bearing ring, wherein the sawteeth of the cross section of the top of the second diameter reducing section are engaged with the sawteeth of the cross section of the bottom of the lifting screw; meanwhile, driving the lifting screw to rise rotatably, wherein the lifting screw rises rotatably to drive the transmission gears to rotate, so as to drive the gear clamping arms to unfold; opening the open-close type pressure bearing ring, relieving the locking of the first diameter reducing section of the reinforcing steel bar body to complete a first unlocking program; then continuing rotating the reinforcing steel bar body clockwise; when the lifting screw touches the top limiter, rotating the reinforcing steel bar body reversely, wherein a second unlocking program is completed when the threaded section of the reinforcing steel bar body is rotated out of the thread limiter, and then the reinforcing steel bar body can be pulled out.

2. The construction method for a recyclable anchor rod according to claim 1, wherein shock-absorbing pressure-bearing devices are arranged between the lower end of the housing and the pressure bearing plate; the housing comprises an inner housing and an outer housing that are nested and connected in a sliding manner; each shock-absorbing pressure-bearing device comprises an outer mold, a moving plate, and a shock absorber; the lower surface of the bottom of the outer mold is fixedly connected to the pressure bearing plate; the top of the outer mold is fixedly connected to the outer housing in a sealed manner; the upper surface of the top of the moving plate is fixedly connected to the lower end of the inner housing; the outer side wall of the moving plate is connected to the inner side wall of the outer mold in a sliding manner; the shock absorber comprises a top sliding block and a sleeve base; the upper surface of the top sliding block is fixedly connected to the lower surface of the top of the moving plate; the lower surface of the bottom of the sleeve base is fixedly connected to the upper surface of the bottom of the outer mold; the top sliding block comprises a top sliding block outer ring body and a top sliding block central body; the top sliding block central body comprises a variable diameter head and a constant diameter shaft; the diameter of the variable diameter head is greater than that of the constant diameter shaft; the outer side wall of the lower part of the top sliding block outer ring body is connected to the inner side wall of the sleeve base in a sliding manner; a limiting clamping seat is located below the top sliding block, and the outer side wall of the limiting clamping seat is connected to the inner side wall of the lower part of the top sliding block outer ring body; a hole is formed in the top of the limiting clamping seat; the variable diameter head is connected to the inner side wall of the limiting clamping seat in a sliding manner through the hole; and the limiting clamping seat limits the reducing head; a support seat is arranged on the upper surface of the bottom of the limiting clamping seat; the lower surface of the bottom of the limiting clamping seat is fixedly connected to the upper surface of the bottom of the sleeve base; a spring surrounds the outer side of the limiting clamping seat; the distance between the spring and the top sliding block outer ring body is greater than the distance between the lower surface of the top of the limiting clamping seat and the top of the variable diameter head; an annular rubber block is arranged on the outer side of the spring; the height of the annular rubber block is less than that of the spring; the height of the spring is less than that of the limiting clamping seat; the annular rubber block is nested inside the sleeve base, and the outer side wall of the annular rubber block is connected to the inner side wall of the sleeve base in a sliding manner; and step three further comprises combining the shock-absorbing pressure-bearing devices.

3. The construction method for a recyclable anchor rod according to claim 2 wherein the shock-absorbing pressure-bearing devices are symmetrically distributed on the periphery of the reinforcing steel bar body.

4. The construction method for a recyclable anchor rod according to claim 2, wherein the support seat is arranged below the variable diameter head.

5. The construction method for a recyclable anchor rod according to claim 2, wherein in step three, the shock-absorbing pressure-bearing devices are connected to the pressure bearing plate by welding or bolting.

6. The construction method for a recyclable anchor rod according to claim 2, wherein in step six, when the anchor rod is subjected to an earthquake damage during supporting and protecting, tensioning and locking processes are repeated after an earthquake, so as to recover a working state of the anchor rod before the earthquake.

7. The construction method for a recyclable anchor rod according to claim 1, wherein lifting screw limiters are symmetrically arranged at the upper end and the lower end of the fixed panel.

8. The construction method for a recyclable anchor rod according to claim 1, wherein the recyclable anchor rod further comprises a plastic sleeve; the lubricating treatment is performed between the reinforcing steel bar body and the plastic sleeve; and there is no friction between the reinforcing steel bar body and the plastic sleeve.

9. The construction method for a recyclable anchor rod according to claim 1, wherein two sides of the open-close type pressure bearing semi-circular rings are bonded into an open-close type pressure bearing ring by using adhesive tapes; the adhesive tapes achieve an effect of fixing when the open-close type pressure bearing ring is closed; and when the gear clamping arms are unfolded, the open-close type pressure bearing ring is open, and the adhesive tapes are damaged.

* * * * *